US006234666B1

(12) United States Patent
Kolb

(10) Patent No.: US 6,234,666 B1
(45) Date of Patent: May 22, 2001

(54) DYNAMIC DELIVERY LINE MIXING APPARATUS AND METHOD

(75) Inventor: Joseph Christopher Kolb, Madison, AL (US)

(73) Assignee: CTA, Inc., Madison, AL (US)

( * ) Notice: Subject to any disclaimer, the term of this patent is extended or adjusted under 35 U.S.C. 154(b) by 0 days.

(21) Appl. No.: 09/392,204

(22) Filed: Sep. 8, 1999

Related U.S. Application Data

(60) Provisional application No. 60/099,606, filed on Sep. 9, 1998.

(51) Int. Cl.[7] ..... B01F 11/00

(52) U.S. Cl. ..... 366/279; 366/343; 366/349; 366/607

(58) Field of Search ..... 366/194, 279, 366/607, 342, 323, 319, 320, 53, 64, 349; 222/226; 360/117, 118

(56) References Cited

U.S. PATENT DOCUMENTS

| | | | | |
|---|---|---|---|---|
| 370,549 | * | 9/1887 | Lochner | 366/279 |
| 1,053,645 | * | 2/1913 | Reimer | 118/259 |
| 2,279,750 | * | 4/1942 | Gundelfinger | 366/279 |
| 2,532,238 | * | 11/1950 | Malke | 366/607 |
| 2,641,412 | * | 6/1953 | Byberg | 366/319 |
| 2,772,862 | * | 12/1956 | Van Suchtelen | 366/118 |
| 2,954,261 | * | 9/1960 | Taupin | 406/59 |
| 3,063,813 | * | 11/1962 | Weinbrenner et al. | 366/320 |
| 3,920,223 | * | 11/1975 | Krueger | 366/156.2 |
| 4,827,455 | * | 5/1989 | Sivachencko et al. | 366/320 |
| 4,893,937 | | 1/1990 | Braun . | |
| 5,709,777 | | 1/1998 | Begemann et al. . | |

FOREIGN PATENT DOCUMENTS

| | | | | |
|---|---|---|---|---|
| 1717202 | * | 3/1992 | (SU) | 366/279 |

* cited by examiner

*Primary Examiner*—Tony G. Soohoo
(74) *Attorney, Agent, or Firm*—Lanier Ford Shaver & Payne P.C.

(57) ABSTRACT

The present invention is directed to a method and apparatus for dynamic in-line mixing of feedstocks in various delivery systems. The apparatus of the present invention includes an agitator housed within the delivery conduit that is constructed and arranged to impart motion to feedstock passing through the delivery conduit to a discharge device. The method of the present invention is particularly well suited for maintaining metals and other solids in suspension during delivery for specialized coating and/or painting applications. Systems employing the apparatus and method of the present invention are also disclosed.

14 Claims, 5 Drawing Sheets

DYNAMIC DELIVERY LINE MIXING APPARATUS AND METHOD

CROSS-REFERENCE TO RELATED APPLICATIONS

This application claims the benefit of U.S. provisional application No. 60/099,606, filed Sep. 9, 1998.

BACKGROUND OF THE INVENTION

1. Field of the Invention

The present invention relates generally to the field of material mixing methods and apparatus, and more particularly to a dynamic delivery line mixing method and apparatus for actively agitating a feedstock while the feedstock is being passed to a discharge device through a delivery conduit.

While the present invention is subject to a wide range of mixing applications, it is particularly well suited for suspending solids in liquids within the delivery lines of various spray systems, such as sophisticated spray paint systems and coating systems designed for either manual or robotic operation.

2. Technical Background

The vast majority of spray application, fluid processing, and other feedstock delivery systems incorporate one or more fluid delivery conduits through which a feedstock, in liquid, gaseous, or solid form, to include combinations thereof, travels en route to an applicator or other delivery device, such as a spray nozzle, or burner assembly. A common shortcoming associated with such systems is the formation of blockages, either partial or complete, in the delivery conduit. In the case of feedstocks that include solids suspended in a liquid, a contributing factor to these blockages is the separation of the solids from the liquid suspension.

For spray systems such as spray painting systems and spray coating systems used for applying specialty paints and coatings to machines and devices manufactured for specialized government entities such as, but not limited to, the Department of Defense and NASA, this shortcoming is particularly problematic. Typically, the paints and coatings used in such applications are considered highly loaded, in that heavy solids such as metals are suspended in a liquid feedstock to form the paint or coating prior to entering the delivery conduit. Due to the weight of such metals and other solid materials, separation or settling of the solid from the liquid within standard delivery conduits is a common occurrence. The rate at which such solids settle out of suspension depends upon such factors as the rate of delivery of the feedstock to the application device, the weight of the metals, the amount of time the feedstock remains stationary within the line between applications, the length of the delivery conduit, and the number of bends or turns encountered by the feedstock as it passes through the delivery conduit. The slower the delivery, the heavier the metal, the longer the application process is idle, the longer the length of the conduit, and the greater the number and magnitude of the bends, the greater the rate of settling. Even when the feedstock is moving through the conduit, it is essentially moving in one direction, thus, in standard delivery conduits vertical components of force counteracting the force of gravity on these metals are essentially non-existent. Accordingly, even if the feedstock is rapidly forced through the delivery conduit, a significant quantity of solids will settle to the bottom of the conduit over time.

Such setting, over time, results in significant blockages within the delivery conduit, which in turn reduce the efficiency of the spray system being employed. Additionally, many of today's sophisticated computer controlled spray systems are designed to apply paints or coatings at precise rates. When a partial blockage in the delivery line occurs, the systems typically compensate for the reduced flow rate due to the decreased diameter of the conduit by increasing the flow, typically by increasing pressure. Providing this increased flow requires the drive mechanisms to work in excess of their normal operating parameters which often results in undue wear and tear on the drive mechanism, and in certain instances, unexpected failure of the drive mechanism. Moreover, as portions of any such blockages break away from the walls of the delivery conduit, they often become lodged in the reduced diameter orifices of the spray nozzles or jets of the sprayers themselves. The blockages occurring due to the use of standard delivery conduits thus necessitate frequent cleaning of the spray systems which in turn results in increased system down time and business interruption.

In addition, many of the metals and solids delivered in suspension for Department of Defense projects are highly specialized and proprietary in nature. Accordingly, these solids often cost $500.00 or more per quart. Together, the economic loss resulting from frequent cleaning of the delivery systems and significant loss of the solids resulting from cleaning operations often result in lost profits to the system owners, or increased costs to the customers, or both.

In an attempt to overcome these and other shortcomings, systems users have generally taken one of two approaches. One approach is the incorporation of a recirculation pump with present systems. Typically, the recirculation pump is connected to the standard delivery conduit at one or more low points or turns in the delivery line. As solids collect in these low points or turns in the delivery conduit, the recirculation pump is selectively engaged to drain the solids from the delivery conduit and recirculate them back to the supply vessel or pressure pots used to suspend the solids and the liquids prior to the suspension being delivered into the delivery conduit. Such storage vessels or pressure pots typically incorporate a paddle or other mixing device which continuously moves within the vessel to uniformly mix the feedstock. In theory, the solid material returned to the storage vessel via the recirculation pump should maintain the system at equilibrium. However, equilibrium is rarely obtained as the recirculation pump itself becomes a collection site for solid deposits. In addition, the pump components suffer undue wear and tear due to continuous contact with the heavy solid and thus require frequent repair and replacement parts. Moreover, such recirculation systems are often cost prohibitive for the benefits they provide.

The second way systems users have attempted to mitigate against delivery conduit blockages is through the use of static mixers (also known as motionless mixers to those skilled in the art). Static mixers are typically positioned immediately before the delivery conduit or partially within the end of the delivery conduit remote from the application device. Such mixers are typically rigid structures having a plurality of angled surfaces, and are designed to break up the flow of the feedstock as it enters the delivery conduit. As a result of being static, however, the plurality of surfaces of these static mixers themselves become prime collection points for the heavy solids. As a result, the static mixers themselves often promote blockage of the delivery conduits.

In view of the foregoing, there is a need for an apparatus and method for mixing one or more feedstocks within the delivery conduit of feedstock delivery systems such as sophisticated spray paint and coating systems. In addition, there is a need for an apparatus and method that maintains a majority of heavy solids in suspension within the feedstock while the feedstock is passed through the delivery conduits of spray systems and the like. Such a device should be simple to use, inexpensive to manufacture and maintain, and substantially impervious to the substances to which it will be exposed within the delivery conduit. It is to the provision of such a device and method that the present invention is primarily directed.

SUMMARY OF INVENTION

One aspect of the present invention relates to an apparatus for mixing a feedstock. The apparatus includes an elongated conduit through which the feedstock passes, and an agitator positioned within the conduit to communicate with the feedstock. A drive mechanism communicates with the agitator to move the agitator with respect to the conduit, thereby mixing the feedstock.

The present invention is also directed to a method of mixing a feedstock during delivery of the feedstock from a supply vessel to a discharge device. The method includes the steps of urging the feedstock into a hollow elongated conduit coupled at one of its ends to a discharge device and communicating at the other of its ends with a drive mechanism. An agitator housed within the conduit is attached to the drive mechanism. The feedstock is passed through the conduit and around the agitator and one of the agitator or the conduit is moved with respect to the other to mix the feedstock as the feedstock progresses towards the discharge device.

In another aspect, the present invention relates to a system for in-line mixing of a feedstock during delivery of the feedstock to a target. The system includes a supply vessel constructed an arranged to prepare the feedstock a conduit connected to the supply vessel to receive the feedstock, and an agitator positioned within the conduit. A drive mechanism is coupled to at least one of the conduits or the agitator to move one with respect to the other, thereby imparting motion to the feedstock. A discharge apparatus is coupled to the conduit for delivering the feedstock to the target, and a controller is at least connected to the supply vessel and the drive mechanism for receiving inputs and delivering outputs to control the delivery and mixing of the feedstock.

The system, apparatus, and method of the present invention result in a number of advantages over other systems, apparatus, and methods known in the art. For example, the apparatus of the present invention enables delivery systems to effectively and efficiently deliver highly loaded, high performance coating materials designed for demanding defense and space applications, to include many new experimental coating materials. The metals and solids that would otherwise fall out of suspension during delivery of such coatings through the delivery conduits of the systems can now be maintained in suspension. Because the apparatus of the present invention is dynamic in nature, i.e. it actively agitates or mixes these coating materials within the delivery conduit of the delivery systems, the metals and/or other solids are maintained in suspension. Moreover, because the present invention can be adapted for use with any size conduit, the conduit length of such systems is no longer a limiting factor in system design. In addition, because the apparatus of the present invention can agitate these coating materials within the delivery conduit even while the delivery system is idle, blockages within the delivery conduits due to settling can be significantly reduced.

In addition, the method and apparatus of the present invention can be employed to mix more than one feedstock as the feedstocks enter a common conduit from multiple supply locations. The plurality of feedstocks can be a plurality of liquid feedstocks, a liquid and solid feedstock, a liquid and gaseous feedstock, or combinations thereof. Thus, feedstocks that are suspension so such as specialty coatings and paints that are generally susceptible to settling, can now be delivered separately and combined where continuous agitation occurs. As a result, clogging of the delivery systems upstream of the delivery conduit can also be significantly reduced.

Additionally, the present invention provides for flexibility of application and superior transfer efficiency. Because clogging or blockage of the delivery conduit of the present invention is drastically reduced and often eliminated, the apparatus and method of the present invention provides repeatability without frequent cleaning and maintenance, the least amount of waste, and therefore superior cost efficiency for both the user and the customer.

Additional features and advantages of the invention will be set forth in the detailed description which follows, and in part will be readily apparent to those skilled in the art from that description or recognized by practicing the invention as described herein.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, illustrate various embodiments of the invention, and together with the description serve to explain the principals and operation of the invention.

DETAILED DESCRIPTION OF THE PREFERRED EMBODIMENTS

Figure 1:
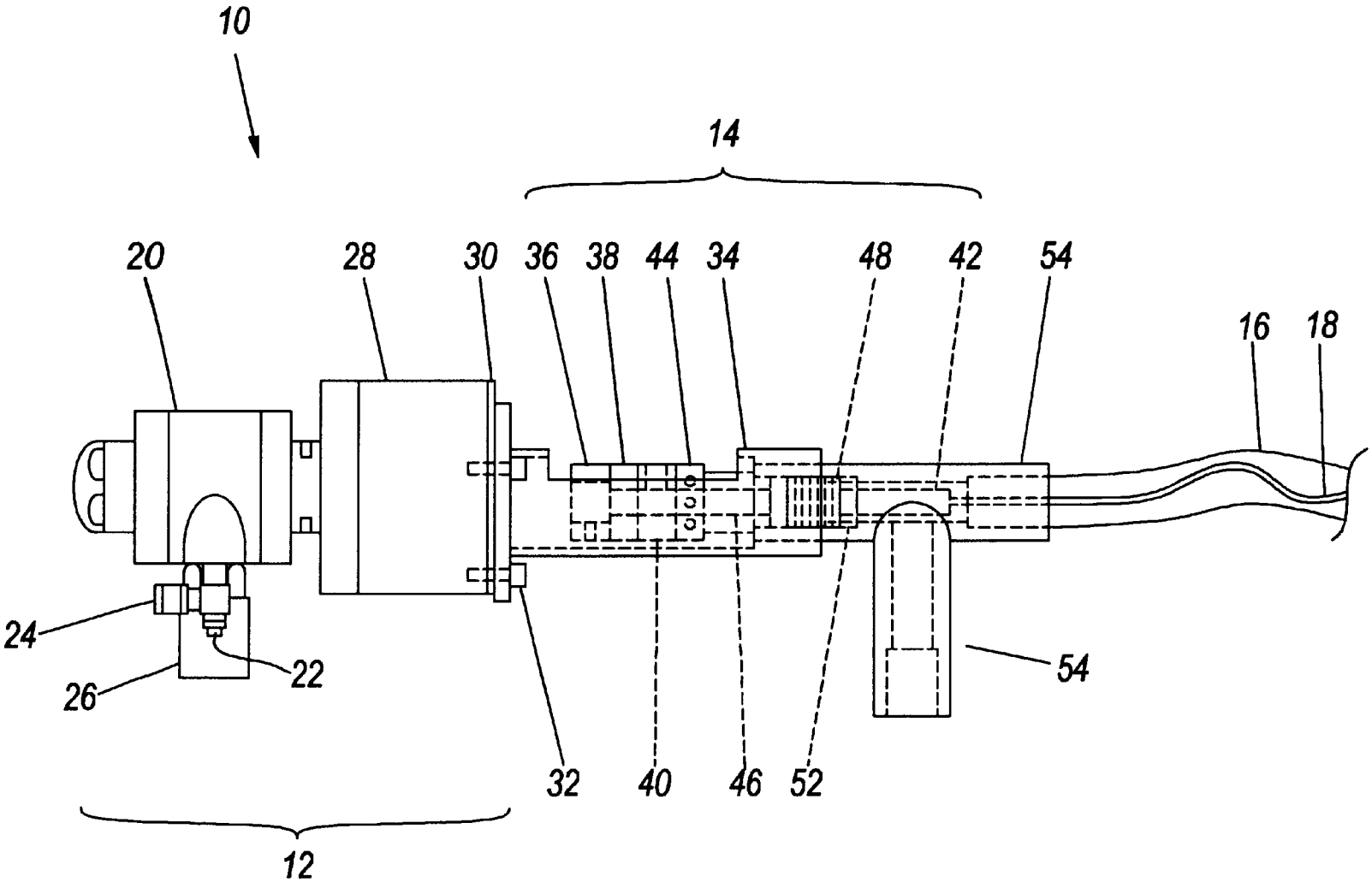
FIG. 1 is a plan view of the apparatus of the present invention depicting details of the coupling assembly in phantom lines.

Reference will now be made in detail to the present preferred embodiments of the invention, examples of which are illustrated in the accompanying drawings. Wherever possible, the same reference numbers will be used throughout the drawing figures to refer to the same or like parts. An exemplary embodiment of the in-line agitator of the present invention is shown in FIG. 1 and is designated generally throughout by reference numeral 10.

In accordance with the invention, the present invention for in-line agitation of feedstocks includes a drive assembly 12, coupling assembly 14, and agitator 18. Agitator assembly 10 is generally connected to a delivery conduit 16, such as, a hollow hose, tube, braided cable, or the like. Agitator 18 is preferably received within delivery conduit 16 and is coupled to drive assembly 12 via coupling assembly 14. Agitator 18 preferably extends along the length of delivery conduit 16 and is moved by drive assembly 12 to agitate feedstocks being passed through the delivery conduit 16.

Figure 2:
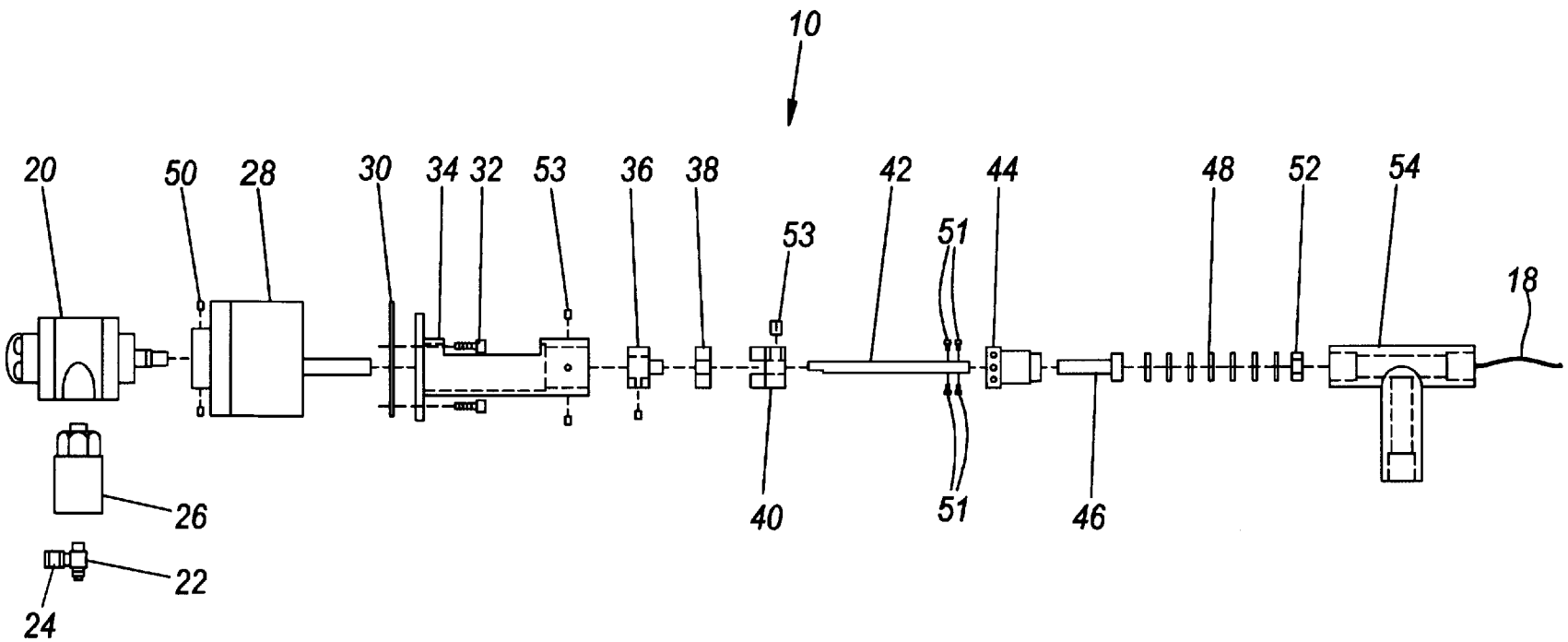
FIG. 2 is an exploded plan view of the apparatus of the present invention.

Agitator assembly 10 can be more easily described with reference to the exploded view depicted in FIG. 2. In a preferred embodiment, drive assembly 12 includes a motor 20 such as, but not limited to, an air motor Model No. 1UP-NRV-11, manufactured by Gast Manufacturing Corp, Benton Harbor, Mich., and a reduction drive or gear assembly 28, such as but not limited to Model No. GR-11, also manufactured by Gast Manufacturing Corp. It will be understood by those skilled in the art that other motors, such as electric motors and hydraulic motors, to name a few, can be used in lieu of pneumatic motors such as motor 20, and that a wide variety of gear assemblies are operative with the present invention. An air inlet fitting 22 having an air adjustment valve 24 associated therewith for controlling air flow to motor 20, and an optional muffler 26 are preferably connected to motor 20. Motor 20 and gear assembly 28 are typically connected with fasteners such as set screws 50.

Coupling assembly 14 can be configured in a number of ways and preferably includes a housing or sleeve 34 for receiving a first coupling 36, a coupling insert 38, a second coupling 40, a drive shaft 42, a crushnut 44, a bushing 46, packing rings 48, a packing spacer 52, and a T-adapter 54. Coupling assembly 14 is preferably mated to gear assembly 28 with a spacing plate 30 positioned therebetween using fasteners, such as screws 32 threadably received through sleeve 34. Drive shaft 42 is coupled to gear assembly 28 at one end, and to agitator 18 within T-adapter 54 with fasteners such as set screws 51. Those skilled in the art will recognize that the remainder of the above-mentioned components of coupling assembly 14 are connected with fasteners such as set screws 53 and the like. Packing rings 48 slidable received onto drive shaft 42, together with crushnut 44, bushing 46, and packing spacer 52 form a seal within coupling assembly 14 when coupling assembly 14 is assembled as shown in FIG. 1. As will be described in greater detail below, the seal prevents feedstocks from entering the sleeved portion of coupling assembly 14 during operation of the delivery system.

Figure 3:
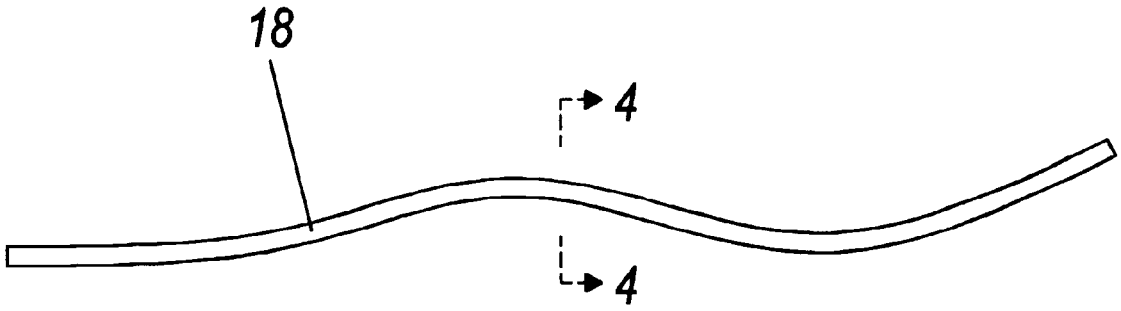
FIG. 3 is a side elevational view of a preferred agitator of the present invention.
Figure 4:
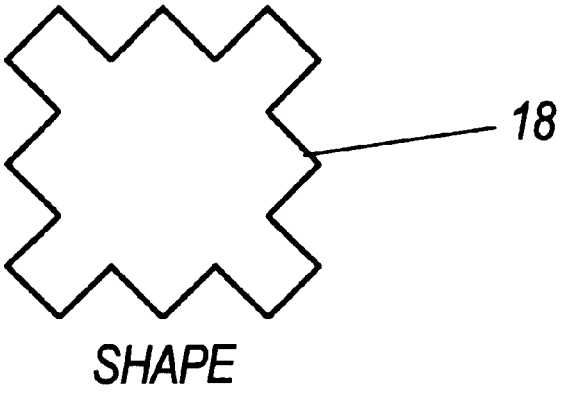
FIG. 4 is a cross-sectional view of the preferred agitator taken through line 4—4 of FIG. 3.

As shown in FIG. 3, the preferred agitator 18 is preferably an elongated flexible cord or line constructed of nylon or some other material compatible with the chemicals, cleaners, and other feedstocks typically used in spray applications. The preferred agitator 18 is a multi-sided structure as shown clearly in the cross-sectional view of FIG. 4. The multiple sides provide increased surface area, and thus increased agitation and turbulence when agitator 18 is moved within conduit 16. It will be understood by those skilled in the art, however, that agitator 18 can be formed to take on any number of shapes, including, but not limited to, a tubular member having either a singular radial dimension or a plurality of radial dimensions. Moreover, agitator 18 can also include a plurality of agitating devices positioned within delivery conduit 16.

In a more complex embodiment of the present invention, one or more agitators 18 can be positioned within delivery conduit 16, and delivery conduit 16 can be moved with respect to the one or more agitators 18 positioned therein. In such an embodiment, the one or more agitators 18 can be in a fixed position with respect to delivery conduit 16, or the one or more agitators can also be moved with respect to delivery conduit 16 as delivery conduit 16 is itself moved. In such an embodiment, the motion of the one or more agitators 18 is preferably in a direction opposite the direction of motion of delivery conduit 16.

Like agitator 18, delivery conduit 16 is preferably manufactured from a material that is substantially impervious to the chemicals, compounds, and/or solutions that form the feedstocks carried by delivery conduit 16. In a preferred embodiment, delivery conduit 16 is a hollow Teflon® tube. Those skilled in the art will recognize, however, that delivery conduit 16 can also be a braided cable made from a non-corrosive metal, a flexible nylon hose, or the like.

Figure 5:
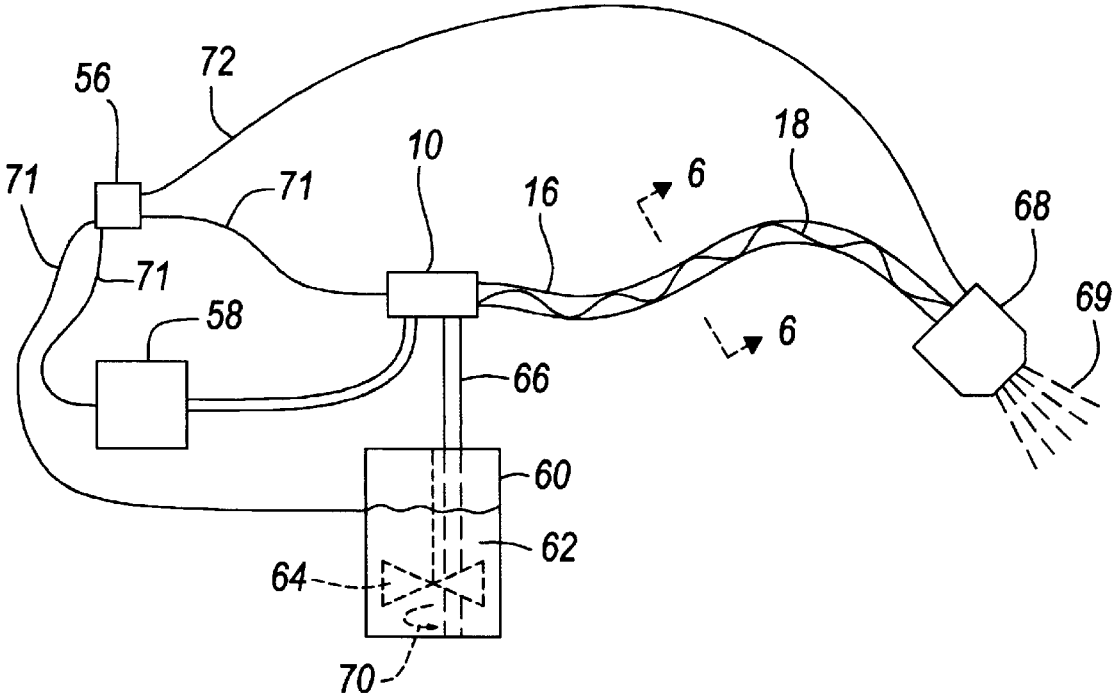
FIG. 5 is a schematic view of a first preferred embodiment of the system of the present invention.

A first preferred embodiment of the method of the present invention is shown schematically in FIG. 5. In-line agitator assembly 10 is connected to a control unit 56, such as a computer, an air supply system 58, and a feedstock supply reservoir 60. In the preferred embodiment of the method of the present invention, feedstock supply reservoir 60 houses a feedstock 62, and includes a mixing device 64, such as a paddle, and a riser 66 for delivering feedstock 62 to agitator assembly 10. Feedstock 62 is transported through riser 66 and into delivery conduit 16 where agitator 18 is rotated by in-line agitator assembly 10. As feedstock 62 passes through delivery conduit 16 en route to a discharge device 68, agitator 18 is moved with respect to deliver conduit 16 to mix feedstock 62 passing therethrough. Generally speaking, feedstock 62 is pre-mixed within feedstock supply reservoir 60 by rotation of mixing device 64 as indicated by directional arrow 70. Accordingly, agitator 18 further mixes feedstock 62 after feedstock 62 leaves feedstock supply reservoir 60.

In a first preferred system for in-line mixing of a feedstock during delivery of the feedstock to a target, such as specialized spray coating and spray painting systems, control unit 56 is connected to in-line agitator assembly 10, air supply system 58, feedstock supply reservoir 60, and discharge device 68 via cable 72. Control until 56 sends and receives signals from agitator assembly 10, air supply system 58, and feedstock supply reservoir 60, and discharge device 68 to control the mixing rate, flow rate, composition, and discharge rate of feedstock 62. Feedstock 62, such as highly loaded coating materials are continuously mixed within the delivery conduit 16 by agitator 18 so that the required composition of coating material 69 is discharged from discharge device 68 onto the target (not shown).

Figure 6:
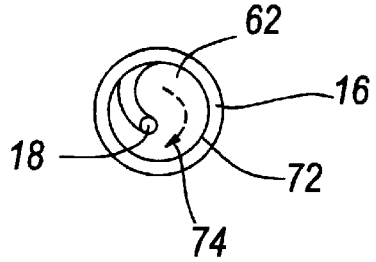
FIG. 6 is a cross-sectional view of the delivery conduit taken through line 6—6 of FIG. 5 depicting the agitator housed therein.

As shown more clearly in FIG. 6, agitator 18 is moved through feedstock 62 as indicated by directional arrow 74 within conduit 18. Due, at least in part, to the torque applied to one end of agitator 18 by agitator assembly 10, agitator 18 generally moves in a helical path within delivery conduit 16. As a result, agitator 18 typically contacts inner walls 72 of delivery conduit 16, thereby dislodging any sediment that may otherwise build-up along inner wall 72 of delivery conduit 16. Solids such as metals are thereby maintained in suspension within feedstock 62 as feedstock 62 enters discharge device 68.

Figure 7:
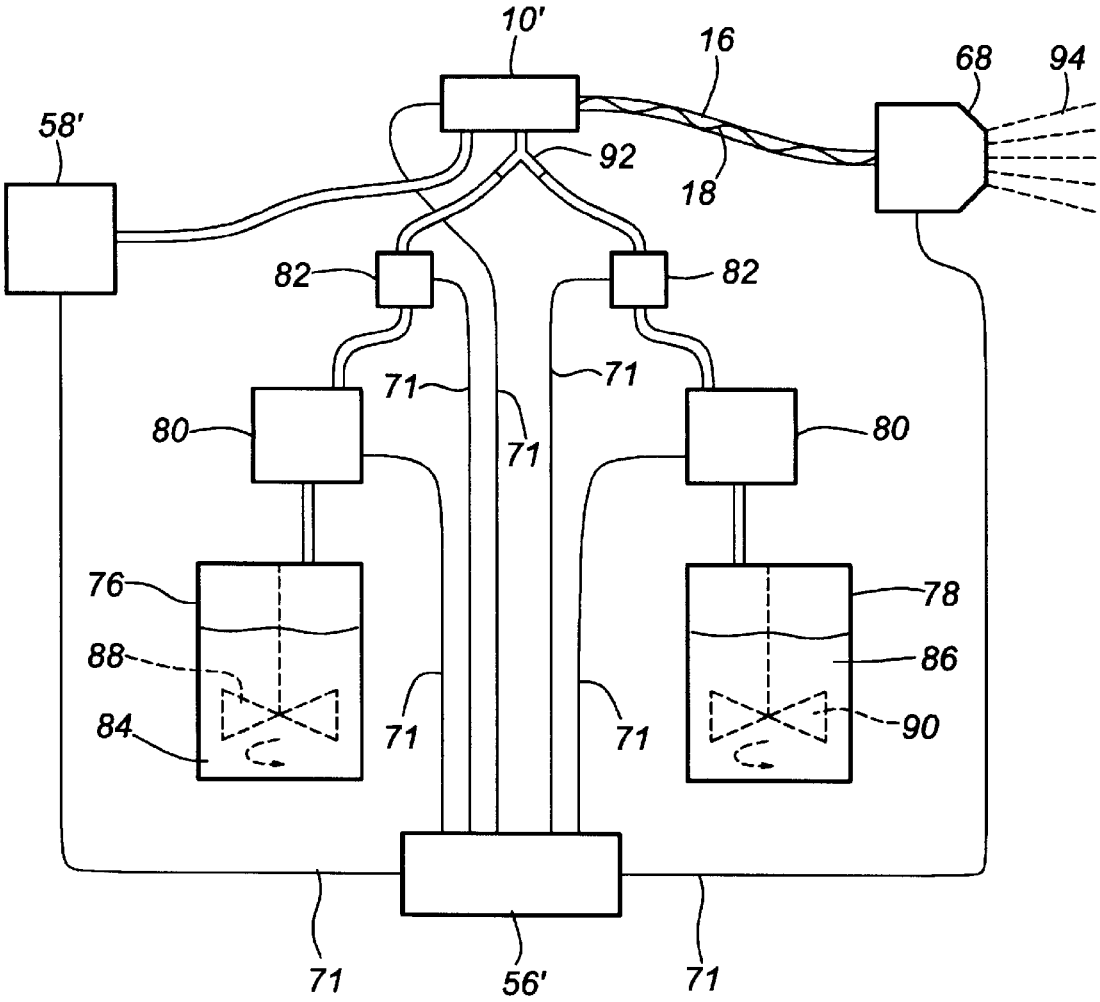
FIG. 7 is a schematic view of a second preferred embodiment of the system of the present invention.

A second embodiment of a system for in-line mixing of feedstocks during delivery of the feedstock to a target is illustrated in FIG. 7. In-line agitator assembly 10 is connected to an air supply system 58, a first supply reservoir 76, and a second supply reservoir 78. Interposed between each supply reservoir 76 and 78 is a metering device 80 and regulator 82. A control unit 56 is preferably connected to each of the above-described components of the system via cables to send and receive data to control such parameters as flow, pressure, rate, and composition.

In the second preferred embodiment of the system of the present invention, first supply reservoir 76 preferably contains a catalyst 84, and second supply reservoir 78 preferably contains a resin 86. Catalyst 84 and resin 86 can optionally be mixed within their respective reservoirs by mixing elements 88, and 90, respectively.

For specialty coating applications, catalyst 84 and resin 86 are delivered through metering devices 80 and regulators 82 in the desired quantities to an adapter 92 which merges the paths of resin 84 and catalyst 86 into delivery conduit 16. Catalyst 84 and resin 86 are mixed within delivery conduit 16 by agitator 18 to suspend resin 86 within catalyst 84 so that the desired composition of coating material 94 is delivered from discharge device 68. This embodiment of the system of the present invention is particularly well suited for feedstocks that are highly unstable in suspension as the system maintains the feedstock (catalyst 84 and resin 86) in separate flow paths until the feedstocks reach delivery conduit 16. In this way, clogging of system components is significantly reduced, as is the loss of materials due to suspension losses.

EXAMPLE

The invention will be further described by the following example which is intended to be exemplary of the invention.

Example 1

Acomparison was made between the first preferred embodiment of the coating system of the present invention as described above with reference to FIG. 5, and a control coating system. The control coating system was an identical coating system absent the operation of the in-line agitator. The comparison included two runs, and in both runs, the discharge end of the 28 foot delivery conduit was elevated to approximately 6 feet above floor level, while the opposite end of the delivery conduit was maintained at about floor level. As a result, the solid material within the feedstock naturally gravitated toward the floor within the delivery conduit, thus making it more difficult to prevent settling in the first run.

A well mixed feedstock suspension was maintained in a constantly agitated supply reservoir or pressure pot. The feedstock contained a solid known to quickly settle out of the suspension prior if to delivery from the spray gun. More specifically, the feedstock contained a specialty Infra-red (I.R.) Coating that included a plurality of heavy metal flakes in a low viscosity polyurethane paint having poor homogeneity. As a first step, a 200 cc sample of feedstock was removed from the pressure pot and found to weigh 250.6 grams. The feedstock was then delivered into a 28 foot Teflon® delivery conduit having a 0.25 inch Inner Diameter (I.D.), and was continuously agitated within the elongated agitator for a period of 15 minutes. After 15 minutes of mixing within the conduit, a 200 cc sample of feedstock was removed from the conduit. The measured weight of this 200 cc sample was approximately 246.4 grams indicating that approximately 4.2 grams of solid material had settled out of the suspension within the delivery conduit during mixing.

The delivery conduit of the coating system was then drained and flushed for the second run of the experiment. Following drainage and flushing, the well mixed feedstock from the pressure pot was delivered into the delivery conduit of the spraying system for the control run. Following 15 minutes without agitation within the delivery conduit, a 200 cc sample of feedstock was removed from the delivery conduit. The weight of this sample was approximately 204.3 grams. Accordingly, approximately 46 grams of solid material was lost from the suspension during the control run.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. An apparatus for mixing a feedstock, said apparatus comprising:

an elongated conduit through which the feedstock passes;

an agitator having a non-circular cross section positioned within said conduit to communicate with the feedstock; and a drive mechanism communicating with said agitator to move said agitator in a substantially helical path within said conduit during delivery of the feedstock through the conduit.

2. The apparatus of claim 1 wherein said elongated conduit comprises a hose.

3. The apparatus of claim 1 wherein said agitator comprises at least one elongated flexible rod.

4. The apparatus of claim 3 wherein said at least one elongated flexible rod is rotatably coupled to said drive mechanism to permit rotation of said at least one elongated flexible rod within said conduit.

5. The apparatus of claim 1 wherein said elongated conduit is selected from the group consisting of a pipe, tube, or braided cable.

6. The apparatus of claim 3 wherein said at least one elongated flexible rod is approximately equal in length to said elongated conduit.

7. The apparatus of claim 1 wherein said agitator comprises nylon.

8. The apparatus of claim 1 wherein said conduit comprises polytetrafluoroetbylene.

9. A method of mixing a feedstock during delivery of the feedstock from a supply vessel to a discharge device, said method comprising the steps of:

a) urging the feedstock into a hollow elongated conduit coupled at one end to the discharge device and communicating at the other of its ends with a drive mechanism, said conduit housing an elongated rod having a non-circular cross section and length less than or equal to the length of said conduit, said elongated rod attached to the drive mechanism;

b) passing the feedstock through said conduit and around said elongated rod; and c) rotating said elongated rod at one of its ends such that said elongated rod moves helically along its length with respect to said conduit to mix the feedstock as the feedstock progresses toward the discharge device.

10. The method of claim 9 wherein said feedstock comprises a solid and a liquid, said solid being suspended in said liquid as said feedstock is urged into said conduit, and wherein said moving step comprises maintaining said solid in suspension as said feedstock passes through said conduit.

11. The method of claim 9 wherein said feedstock comprises a first feedstock and a second feedstock, and wherein said method further comprises the steps of combing and mixing said first and second feedstocks with said agitator as said first and second feedstocks are urged into said conduit.

12. The method of claim 11 wherein said first feedstock comprises a solid and wherein said second feedstock comprises a liquid, and wherein said urging step comprises forming a suspension.

13. The method of claim 11 wherein said first feedstock comprises a liquid and wherein said second feedstock is selected from the group consisting of a liquid or a gas, and wherein said urging step comprises the step of forming a solution.

14. A system for in-line mixing of a feedstock during delivery of the feedstock to a target, said system comprising:

a supply vessel constructed and arranged to prepare the feedstock;

a conduit connected to said supply vessel to receive the feedstock;

an agitator having a non-circular cross section positioned within said conduit;

a drive mechanism coupled to said agitator to move said agitator in a helical path with respect to said conduit to impart motion to the feedstock;

a discharge apparatus coupled to said conduit for delivering the feedstock to the target; and a controller connected to said supply vessel, and said drive mechanism for receiving inputs and delivering outputs to control the delivery and mixing of the feedstock.

* * * * *